United States Patent [19]

Moore et al.

[11] 4,362,204

[45] Dec. 7, 1982

[54] METHOD AND APPARATUS FOR CURING A FOUNDRY CORE

[75] Inventors: Russell H. Moore, Gladstone; Patrick O'Meara, Madison Heights, both of Va.

[73] Assignee: The Mead Corporation, Dayton, Ohio

[21] Appl. No.: 309,740

[22] Filed: Oct. 8, 1981

Related U.S. Application Data

[63] Continuation of Ser. No. 130,790, Mar. 17, 1980, abandoned.

[51] Int. Cl.[3] ..... B22C 1/22

[52] U.S. Cl. ..... 164/16; 164/526

[58] Field of Search ..... 164/12, 16, 526, 159, 164/228; 252/182; 366/16-19

[56] References Cited

U.S. PATENT DOCUMENTS 3,888,293 6/1975 Laforet et al. ..... 164/16

4,112,515 9/1978 Sandow ..... 164/16 X

FOREIGN PATENT DOCUMENTS 2704868 8/1978 Fed. Rep. of Germany ..... 164/12

*Primary Examiner*—Gus T. Hampilos

*Assistant Examiner*—K. Y. Lin

*Attorney, Agent, or Firm*—Biebel, French & Nauman

[57] ABSTRACT

A method and apparatus is disclosed for the high-speed production of foundry cores of the type in which a foundry aggregate is mixed with a curable binder, preferably an isocyanate or phenolic material, to form a core mixture which is carried within a hermetically sealed core box and is hardened by the introduction into the core box of a gaseous curing agent, preferably an amine. A positive displacement pump pumps a predetermined amount of liquid amine from a holding tank to a vaporizer where it is heated and completely vaporized. The vaporized curing agent is forced from the vaporizer by the introduction of an inert gas, preferably nitrogen, and the mixture of the inert gas and the vaporized curing agent is entrained in a low pressure air stream which carries it to the core box, thereby curing the core. After the core is cured, valves close to stop the flow of the low pressure air stream, the mixture of inert gas and curing agent to the low pressure air stream, and the flow of inert gas to the vaporizer. At this time, a high pressure air stream is introduced into the core box thereby purging the curing agent from the core, and, simultaneously, the positive displacement pump is activated to dispense another predetermined amount of liquid amine into the vaporizer to initiate the process. The system includes a control for sequentially opening and closing the valves and activating the positive displacement pump.

7 Claims, 2 Drawing Figures

METHOD AND APPARATUS FOR CURING A FOUNDRY CORE

This is a continuation of application Ser. No. 130,790 filed Mar. 17, 1980, now abandoned.

BACKGROUND OF THE INVENTION

1. Field of the Invention

The present invention relates to a method and apparatus for curing foundry cores, and, in particular, a method and apparatus whereby a vaporized curing agent is introduced into a core mixture to harden a curable binder mixed with the foundry aggregate of the core.

2. Prior Art

Foundry cores or molds are made from sand or similar foundry aggregate which is held together in the desired shape by means of a binder. Generally, the process used to form the foundry core comprises mixing the foundry aggregate with the binder, forming the mixture into the desired shape, then treating the mixture so that the binder hardens sufficiently so that the core can be handled.

The efficiency and dimensional quality of the core is enhanced if the curing or hardening of the core is achieved in a minimum amount of time. It is also desirable to harden the core without heating the mixture, as this may cause the core to deform thereby losing dimensional accuracy.

Various methods have been employed in an attempt to cure rapidly the mixture of foundry aggregate and binder. These methods commonly employ an isocyanate or phenolic material as a binder and harden the mixture by introducing an amine, in particular triethylamine or dimethylethylamine, to the mixture either in the form of a gas or a fine mist. The amine acts as a catalyst to promote cross linking of the binder, thereby hardening the core mixture.

An example of such a process is disclosed in U.S. Pat. No. 3,888,293, which discloses the curing of a foundry core by the introduction of an amine vapor which is mixed with an inert gas carrier and blown into the core. A pool of liquid amine in a generating tank is heated to form amine vapor. Inert gas, such as nitrogen, is blown into the tank, mixes with the amine vapor, and the mixture exits the tank to pass through a surge tank where it is mixed with additional inert gas to form a vapor solution of a normally liquid amine in an inert carrier gas.

The vapor solution exiting the surge tank flows to a T-joint where it is entrained in an inert gas of low pressure and carried into the core where the outer portion of the core mixture is "flash cured". A second gasing occurs in which a high pressure stream of inert gas entrains the vapor solution and drives the vapor solution into the inerior portion of the core mixture. The core mixture is then purged by the introduction of a stream of shop air which drives the vapor solution from the core into a holding tank or air scrubber.

A disadvantage of this system is that it is necessary to control the concentration of the amine in the vapor solution by using a surge tank downstream of the generating tank. In addition, the generating tank must be large enough to hold a predetermined amount of liquid amine at all times during operation and provide a sufficient air space above the liquid amine to allow mixing of the amine with the inert gas so that droplets of liquid amine are not carried with the mixture through the system. Additional equipment would be required to drain the generating tank and provide for the cooling off of the liquid amine when the system is shut down, further complicating the overall operation.

In U.S. Pat. No. 4,051,886, a foundry mold curing system is disclosed in which an inert gas, such as carbon dioxide, is bubbled through a quantity of liquid amine held in a tank so that the carbon dioxide becomes a vapor saturated with liquid amine. The resulting saturated vapor is then blown into the core box to cure the core mixture. Again, a large tank is required to hold the liquid amine and permit a large air space to remain above the liquid. This patent teaches away from heating the liquid amine to form a gas. Instead, it is suggested that the liquid amine be maintained at ambient temperature so that the saturated vapor does not condense in the lines leading to the core box.

A disadvantage of this system is that the velocity of the carbon dioxide through the liquid amine must be slow so that a proper amount of amine may be absorbed by the carbon dioxide gas. In addition, a large tank is required which would add to the expense of the system and the difficulty in fabrication of the components. Finally, there is no means for regulating the concentration of the amine absorbed by the carbon dioxide or regulating the flow of the carbon dioxide mixture other than an air operated gassing valve. As with the aforementioned system, liquid amine must be drained from the holding tank when the system is shut down.

Accordingly, the need exists for a more efficient system for introducing a curing agent, such as amine, into a core mixture.

SUMMARY OF THE INVENTION

The present invention provides a process and apparatus for curing foundry cores in which a predetermined amount of liquid curing agent such as liquid amine is pumped into a vaporizer, completely vaporized, mixed with a quantity of inert gas, then injected into an air stream which delivers the mixture to the core box, thereby curing the core mixture. Since only a measured amount of liquid amine is injected into the vaporizer at any one time, less amine is used, there is no need for a large size generating tank of the type employed by those systems in which liquid amine and amine vapor must coexist in the tank, nor are the complex controls required to prevent introduction of liquid amine into the core mixture.

The method and apparatus of the present invention control the concentration of amine in the mixture injected into the core box by controlling the amount of liquid amine pumped into the vaporizer. This eliminates the need for the mixing apparatus downstream of the vaporizer, thus further reducing the complexity in cost of the system. In addition, there is little if any residual liquid amine remaining in the vaporizer after operation. Therefore, elaborate apparatus for draining liquid amine from the vaporizer is not required.

The process for curing foundry cores of the present invention comprises the steps for causing a predetermined amount of liquid curing agent (0.05–0.2% by weight of the foundry aggregate) to flow into a vaporizer, vaporizing completely the curing agent by the addition of heat to the vaporizer, evacuating the vaporized curing agent from the vaporizer by the introduction of an inert carrier gas at approximately 20–50 psi whereby a catalyzing mixture is formed consisting of the vaporized curing agent and the inert carrier gas, injecting the catalyzing mixture into an air stream having a pressure of approximately 5–30 psi, passing the air stream about the core mixture within the core box thereby curing the core, and purging the air stream at approximately 25–50 psi carrying the catalyzing mixture from the box. It is preferable to perform the step of purging the air stream carrying the catalyzing mixture from the cavity of the core box and pumping a predetermined amount of a liquid curing agent into the vaporizer simultaneously in order to accelerate the recycle time of the system.

The system for curing foundry cores which performs the aforementioned process comprises a vaporizer, a positive displacement pump communicating with the vaporizer for pumping a predetermined quantity of liquid amine (0.05–0.2% by weight of the foundry aggregate) to the vaporizer, a first conduit for conveying an inert gas to the vaporizer at approximately 20–50 psi, a second conduit communicating with the core box for conveying low pressure air (approximately 5–30 psi) to the core box, a third conduit extending between the vaporizer and the second conduit whereby the mixture of the inert gas and the curing agent within the vaporizer is injected into the low pressure air, and a fourth conduit which joins the second conduit whereby a stream of high pressure air (approximately 25–50 psi) is injected to purge the catalyzing mixture from the core box. Each conduit is fitted with a check valve and a poppet valve which is remotely operated by an electronic control.

As the core mixture is being cured, the poppet valves located on the first, second, and third conduits are opened allowing the catalyzing mixture to flow to the core box by way of the low pressure air stream. In the purging stage of the operation, these valves are closed and the valve on the fourth conduit is opened to permit a high pressure stream of air to enter the core box to purge the catalyzing mixture from the core. Simultaneously with this purging step, the positive displacement pump is activated thereby charging the vaporizer to initiate the process.

Accordingly, it is an object of the invention to provide a process and apparatus in which small, predetermined amounts of liquid curing agent are injected into a vaporizer to be mixed with an inert gas and delivered to a core mixture; to provide a process and apparatus in which only a small amount of curing agent remains in the vaporizer when the system is shut down; to provide a process and apparatus for curing foundry cores in which rapid curing of the foundry core and a rapid recycle time is effected; and to provide a process and apparatus for curing foundry cores in which the concentration of the curing agent gas in the catalyzing mixture delivered to the foundry core is regulated by the amount of liquid curing agent delivered to the vaporizer rather than regulating the mixture leaving the vaporizer.

Other objects and advantages of the invention will be apparent from the following description, the accompanying drawings and the appended claims.

DETAILED DESCRIPTION OF THE PREFERRED EMBODIMENT

Figure 1:
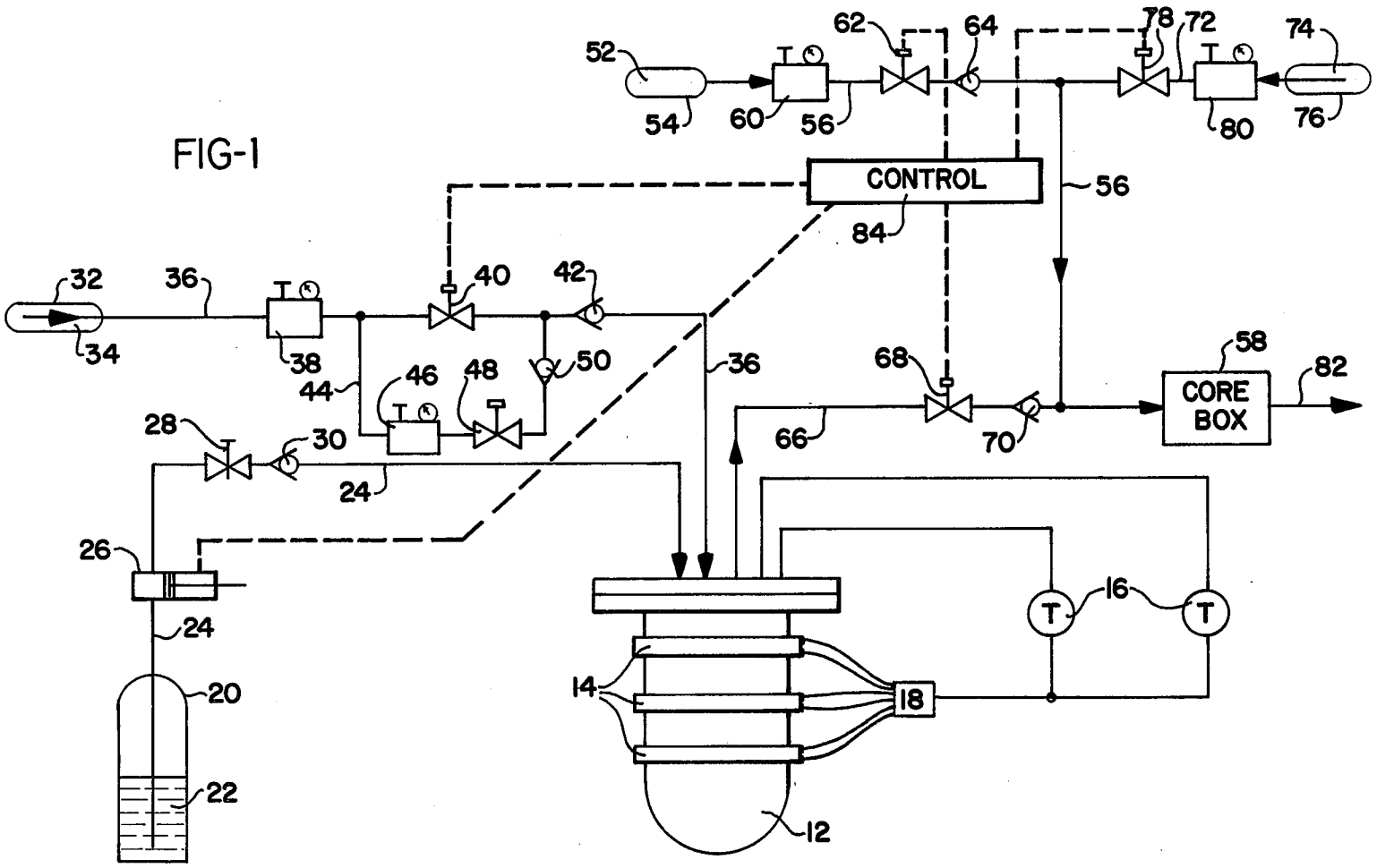
FIG. 1 is a schematic of the system of the present invention.

As shown in FIG. 1, the curing system includes a vaporizer 12, which consists of an insulated tank which is heated by band heaters 14. The band heaters 14 are of the electric resistance type and their operation is controlled by thermostats 16 which monitor the temperature within the vaporizer 12. A thermostat control 18 activates the band heaters 14 when the temperature within the vaporizer 12 falls below a predetermined temperature, typically between 200 F. and 400 F.

A tank 20 of a liquid curing agent 22, typically liquid amine, is connected to the vaporizer 12 by a supply line 24. A positive displacement pump 26 is located on the supply line 24 and is capable of withdrawing measured quantities (0.05–0.2% by weight of the foundry aggregate) of liquid curing agent 22 from the tank 20 and pumping it through the supply line. The supply line 24 also includes a poppet valve 28 and check valve 30 located between the positive displacement pump 26 and the vaporizer 12.

A tank 32, containing an inert gas 34 such as nitrogen, argon or carbon dioxide, is connected to the vaporizer 12 by a first conduit 36. The first conduit 36 includes a pressure regulator valve 38 (set at 20–50 psi), a remotely controlled poppet valve 40 and a check valve 42 to prevent backflow of the inert gas and curing agent. The first conduit 36 also includes a spur line 44 which carries its own pressure regulator valve 46, poppet valve 48 and check valve 50. The check valve 50 is positioned on the spur line 44 to prevent backflow of the inert gas 34 and curing agent into the tank 32.

A source of low pressure air 52 (held at 160°–200° F.), which can be a tank 54 or simply a compressor (not shown), is connected by a second conduit 56 to a core box 58 containing the foundry core (not shown) to be cured. The second conduit 56 also carries a pressure regulator valve 60 (set at 5–30 psi), a remotely controlled poppet valve 62, and a check valve 64 aligned so that it prevents flow of the air 74 away from the core box 58 to the tank 54.

A third conduit 66 connects the interior of the vaporizer 12 with the second conduit 56 at a point between the core box 58 and the check valve 64. The third conduit 66 carries a remotely controlled poppet valve 68 and a check valve 70 mounted so that flow from the second conduit 56 to the vaporizer 12 is prevented.

A fourth conduit 72 connects the second conduit 56 with a source of high pressure air 74 (held at a temperature of 160°–200° F.) held within a tank 76 or generated by a compressor (not shown). The fourth conduit 72 joins the second conduit 56 at a point between the check valve 62 and the juncture with the third conduit 66. The fourth conduit 72 also carries a remotely controlled poppet valve 78 and a pressure regulator valve 80 (set at 25–50 psi).

The core box 58 has an exhaust line 82 which can be connected to an air scrubber or holding tank (not shown). Means for sequentially removing a core from core box 58 whose core has been appropriately cured and refilling it with an uncured foundry aggregate are well-known in the art and can be incorporated with the present system.

It is essential to the efficient operation of the system that the poppet valves 40, 62, 68, 78, and the positive displacement pump 26 be activated at the appropriate times. Therefore, the system also comprises a control 84 programmed to operate remotely these valves and the positive displacement pump in the proper sequence.

The method of operation of the system is as follows. On start up, the positive displacement pump 26 is activated manually to pump a predetermined quantity of liquid curing agent 22 from the tank 20 through the supply line 24 to the vaporizer 12. The curing agent 22 is vaporized upon entering the vaporizer 12, which is maintained at the vaporizing temperature by the band heaters 14.

After a core box 58 containing an uncured foundry core is connected to the system, the control 84 opens poppet valves 40, 62, and 68. Inert gas 34 enters the vaporizer 12 and forces the vaporized curing agent out through the third conduit 66. Low pressure heated air 52 travels through the second conduit 56, entrains the mixture of inert gas 34 and vaporized curing agent from the third conduit 66, and enters the core box 58. The vaporized curing agent hardens the curable binder in the foundry aggregate of the foundry core within the box and the hardening process is completed in approximately one to two seconds.

The control 84 next closes poppet valves 40, 62, and 68 and opens poppet valve 78. Now heated compressed air 74 is permitted to travel through the fourth conduit 72 and purge the low pressure air 52 containing vaporized curing agent from the second conduit 56 and the core box 58 out through the exhaust line 82. Thus, the low pressure air 52 carrying the vaporized curing agent is purged from the system from a point downstream of the check valves 64 and 70 of the second and third conduits 56 and 66 respectively.

Simultaneously with the opening of the poppet valves 78 by the control 84, the control activates the positive displacement pump 26 to pump a second quantity of liquid curing agent 22 into the vaporizer 12 to initiate the start of the next cycle. By the time the purging step has been completed, the curing agent 22 will have vaporized sufficiently for the control 84 to open the poppet valves 40, 62, and 68.

Thus, the process of the system can cure a number of foundry cores in rapid succession, the cycle time limited chiefly by the refilling of core box 58.

To shut the system down, the control 84 closes poppet valves 40, 62, 68, and 78 and stops operation of the positive displacement pump 26. In addition, poppet valve 28 is closed to prevent leakage of liquid curing agent 22 into the vaporizer 12 and check valve 30 prevents the contents of the vaporizer from returning to the tank 20.

As the system cools, the heated gases in the vaporizer 12 will contract, creating a partial vacuum. In order to maintain the proper pressure within the vaporizer 12, the poppet valve 48 is opened and the pressure regulator valve 46 permits the vaporizer 12 and the first conduit 36 to maintain a predetermined pressure, preferably 4 p.s.i., as the system cools. Thus, the spur line 44 permits inert gas 34 to flow into the vaporizer 12 to maintain a positive pressure and an inert atmosphere during shut down.

Figure 2:
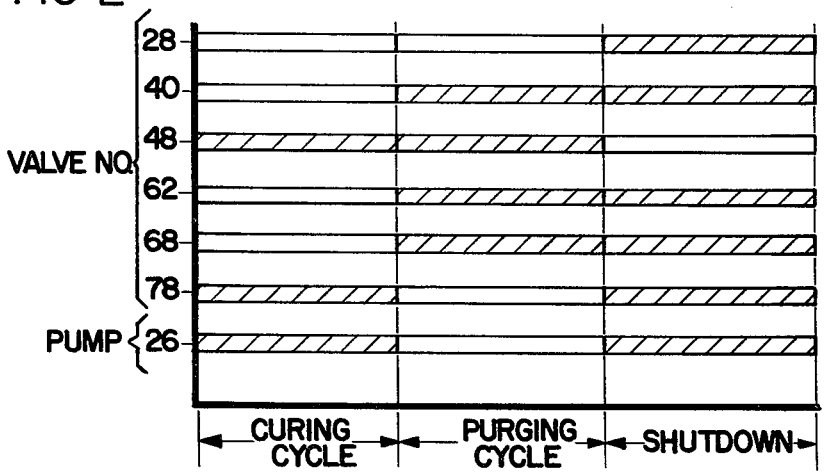
FIG. 2 is a valve timing diagram displaying the times during the operation of the system in which the various valves are opened and closed.

FIG. 2 is a valve diagram which shows the sequence of opening and shutting the valves of the system by the control 84 (closed valves being shaded, open valves being unshaded). Also included is valve 28 located on the supply line 24 and valve 48 on line 44 which can be manually controlled since valve 28 is open at all times during the operation of the system and is closed when the system is shut down and valve 48 is closed at all times during operation of the system and is opened only when the system is shut down.

The system can be manufactured from components readily available in the market. For example, the poppet valves can be operated by an electric solenoid and are preferably of the type that is normally closed. Preferably, the conduits should be made of corrosion resistant stainless steel, as should the inner tank of the vaporizer 12, although practice has shown that brass and carbon steel are viable substitutes.

While the form of apparatus herein described constitutes a preferred embodiment of this invention, it is to be understood that the invention is not limited to this precise form of apparatus, and that changes may be made therein without departing from the scope of the invention.

What is claimed is:

1. A process for curing foundry cores of the type in which a foundry aggregate is mixed with a curable binder to form a core mixture which is carried within a hermetically sealed core box comprising the steps of:

causing a liquid amine curing agent in the amount 0.05 to 0.2% by weight of foundry aggregate to flow into a vaporizer;

vaporizing completely the curing agent by the addition of heat to the vaporizer;

evacuating the vaporized curing agent substantially completely from the vaporizer by the introduction of an inert carrier gas at a pressure of between 20 and 50 pounds per square inch into the vaporizer whereby a catalyzing mixture is formed consisting of the vaporized curing agent and the inert carrier gas;

injecting the catalyzing mixture into a lower pressure stream of air pressurized to between 5 and 30 pounds per square inch and at a temperature sufficient to maintain the mixture in a gaseous state such that the resultant mixture has a pressure of between 5 and 50 pounds per square inch;

passing the air stream bearing the catalyzing mixture at a pressure of between 5 and 50 pounds per square inch about the core mixture within the core box thereby curing the core; and purging the catalyzing mixture from the box.

2. The process of claim 1 wherein the step of purging the catalyzing mixture from the core box comprises the steps of:

interrupting the flow of the air stream bearing the catalyzing mixture to the core mixture; and p1 introducing a second air stream into the core mixture.

3. The process of claim 2 wherein the step of purging the catalyzing mixture from the core box further includes the step of causing a predetermined amount of the liquid curing agent to flow into the vaporizer simultaneously with the step of introducing a second air stream into the core mixture.

4. The process of claim 1 wherein the vaporizer is heated to a temperature of from about 200° F. to about 400° F.

5. The process of claim 1 wherein said curable binder is selected from the group consisting of an isocyanate and a phenolic material.

6. The process of claim 1 wherein a positive displacement pump causes the predetermined amount of a liquid curing agent to flow into the vaporizer.

7. The process of claim 1 wherein the inert carrier gas is nitrogen.

* * * * *

UNITED STATES PATENT AND TRADEMARK OFFICE

CERTIFICATE OF CORRECTION

PATENT NO. : 4,362,204

DATED : December 7, 1982

INVENTOR(S) : Russell H. Moore and Patrick O'Meara

It is certified that error appears in the above—identified patent and that said Letters Patent is hereby corrected as shown below:

Col. 6, line 48, "P1" should be deleted.

Signed and Sealed this

*Third* Day of *May 1983*

[SEAL]

*Attest:*

GERALD J. MOSSINGHOFF

*Attesting Officer*

*Commissioner of Patents and Trademarks*